US005108118A

United States Patent [19]

Schaevitz

[11] Patent Number: 5,108,118

[45] Date of Patent: Apr. 28, 1992

[54] MECHANIC'S CREEPER

[76] Inventor: Lester P. Schaevitz, 431 N. Latch's La., Merion Station, Pa. 19066

[21] Appl. No.: 451,192

[22] Filed: Dec. 15, 1989

[51] Int. Cl.[5] ..... B25H 5/00

[52] U.S. Cl. ..... 280/32.6

[58] Field of Search ..... 280/32.6, 32.5, 79.4, 280/79.7, 62, 87.042

[56] References Cited

U.S. PATENT DOCUMENTS

| | | | |
|---|---|---|---|
| 2,154,952 | 4/1939 | Mahloch | 280/32.6 |
| 2,509,934 | 5/1950 | Murray | 280/32.6 |
| 2,843,391 | 7/1958 | Pelletier | 280/32.6 |
| 2,909,377 | 10/1959 | Ulinski | 280/62 |
| 3,990,713 | 11/1976 | Hokanson | 280/87.042 |
| 4,195,857 | 4/1980 | Hechinger | 280/87.042 |
| 4,792,147 | 12/1988 | Wissing | 280/32.6 |

FOREIGN PATENT DOCUMENTS

| | | | |
|---|---|---|---|
| 137666 | 10/1952 | Sweden | 280/62 |

*Primary Examiner*—Mitchell J. Hill
*Attorney, Agent, or Firm*—Robert Charles Beam

[57] ABSTRACT

A mechanic's creeper having improved strength and increased mobility without sacrifice in work height, for use on a work surface is disclosed. The improved creeper comprises a triangular array of three straight castors, an integral frame suspended from the castors. The frame comprises a plurality of structural members and a plurality of weight bearing cross-bracing members engaging the castors, thereby transferring the weight of the structural members and any load placed thereupon to the castors.

11 Claims, 4 Drawing Sheets

MECHANIC'S CREEPER

FIELD OF THE INVENTION

The present invention relates to a mechanic's creeper having improved strength and increased mobility without sacrifice in work height for use on a work surface.

DESCRIPTION OF THE PRIOR ART

Creepers on rollers which are used on relatively smooth and level work surfaces, such as concrete paving and asphalt driveways, and the like, for example by automobile mechanics and others, which have castors or wheels which roll along the smooth floor or other surface, are well known and have been used for many years with varying results. Depending upon the wheel, or castor, size and the smoothness and regularity of the surface on which they are employed, the wheeled creepers of the prior art have been used with varying degrees of success by various workmen who must lie on their backs and maneuver into confined areas, such as under cars or other structures or machinery.

Typical of the wheeled creepers of the prior art is the creeper commonly employed by auto mechanics today. This creeper typically consists of a rectangular plywood body braced around the edges with a strip of wood of some kind. Such creepers are typically supported at each corner by an offset castor of some kind, with the common use of offset castors intended to minimize the height of the creeper.

While these wheeled creepers of the prior art provide good results on smooth surfaces free of minor surface irregularities, even such minor irregularities as the expansion joints in a concrete floor present difficulties to their movement. Further, because the castors are offset, and subject to misalignment, it is often a difficult and tedious job to properly position such a creeper when such positioning is important.

Another difficulty of the creeper referred to is the strength of the plywood body. It is not uncommon for such a creeper to fail in service. Such failure may occur because of the weight of a mechanic employing the creeper. Or, the creeper may fail because it has been misused, such as by employing the creeper to serve as a dolly for an article of great weight, such as an automobile transmission, or the like.

One further difficulty which has been encountered with the common creeper of the prior art is the lack of support the creeper provides. Often the mechanic, or other worker employing the creeper is called upon to work at some elevation above the floor, although maneuvering into position for such work may be facilitated by a creeper. This might occur if a mechanic were performing work on a truck or other vehicle, which required entry from underneath but where the work area was still sufficiently high to make working from a prone position inconvenient.

SUMMARY OF THE INVENTION

It is an object of the present invention to provide a mechanic's creeper which will be more maneuverable in the work place.

It is a further object of the present invention to provide a mechanic's creeper with a stronger structure, permitting a greater service life in use.

It is an object of another embodiment of the present invention to provide a mechanic's creeper which will provide back support for a mechanic working under an object but where the work area is still sufficiently high to make working from a prone position inconvenient.

It is a further object of the present invention to provide a mechanic's creeper which will accomplish the other objects without any sacrifice in work height, allowing the improved creeper of the present invention to be used for the same low clearance tasks as the creeper of the prior art.

The other objects, features and advantages of the present invention will become more apparent in light of the following detailed description of the preferred embodiments thereof.

According to one embodiment of the present invention, there is provided a mechanic's creeper having improved strength and increased mobility without sacrifice in work height, for use on a work surface, which improved creeper comprises:

- a triangular array of three straight castors,
  - said triangular array having at least two sides approximately equal in length, and defining a horizonal plane of surface contact therebelow,
  - each said castor having
    - at its lower periphery a surface contact member rotational in a plane vertical to the horizonal plane of surface contact, and
    - at its upper periphery a load-bearing connection mechanism member rotational in a horizonal plane parallel to the plane of surface contact; and,
- an integral frame operatively engaged to and suspended from the connection mechanism members of said castors and comprising:
  - a plurality of structural members, each structural member having a lower periphery located above the plane of surface contact and an upper support surface at a height above the contact surface approximately equal to the height of the castors; and
  - a plurality of weight bearing cross-bracing members in mating engagement with said structural members and wherein each cross-bracing member operatively engages at least one connection mechanism member at the upper periphery of at least one of said castors;

thereby transferring the weight of the structural members and any load placed thereupon to the castors.

DETAILED DESCRIPTION OF THE INVENTION

Figure 1:
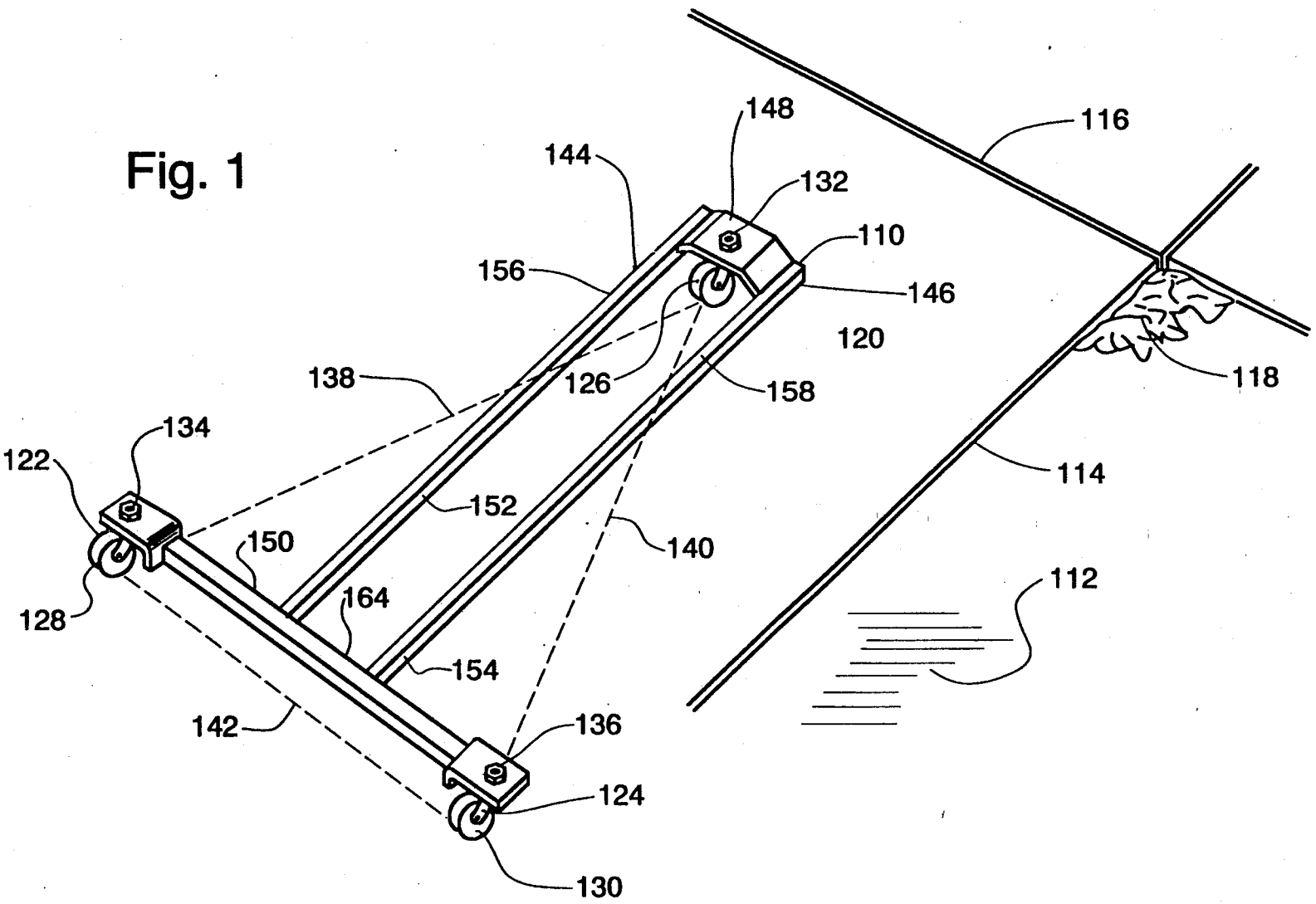
FIG. 1 shows the structure of the basic embodiment of the present invention.

The basic structure of the present invention is shown generally as 110 in FIG. 1. In that drawing, the basic mechanic's creeper 110 rests on a surface 112 which may be concrete or some other relatively flat surfaced material work surface. The surface may contain minor irregularities, such as the expansion grooves 114 and 116 or the surface pitting 118 common to exposed concrete.

The creeper of the prior art would have difficulty in maneuvering easily over a surface such as the surface 112 because of its irregularities. The creeper of the prior art is typically provided with offset castors, which must first be aligned before they will roll in a particular direction. The narrow wheel-shaped member of such off-set castors can easily become lodged in an imperfection, such as expansion groove 114, and could not easily be dislodged. The mechanic's creeper 110, of the present invention, however, is able to maneuver easily over the same surface despite such irregularities.

In the basic embodiment shown in FIG. 1, the mechanic's creeper 110 comprises an array of three straight castors 120, 122, and 124, each such castor having a rotational member 126, 128, and 130, respectively, and a load-bearing connection mechanism 132, 134, and 136 at its upper periphery. These casters are located in a triangular arrangement such that the rotational members 126, 128, and 130, respectively, define a plane of surface contact therebelow.

The triangle defined by the castors 120, 122, and 124 may be equilateral, but it has been shown to be more effective if the sides 138 and 140 are equal and slightly longer than the side 142. This accommodates the need to support more of the length of someone using the creeper 110 then the width, and also the need to maneuver into narrow openings.

The basic mechanic's creeper 110 of FIG. 1 is further provided with an integral frame suspended from said castors 120, 122, and 124. This structural frame comprises structural members, 144 and 146, and weight-bearing cross-bracing members 148 and 150.

Each of these structural members, 144 and 146, have a lower periphery or surface 152 and 154 located above the plane of the contact surface 112 and an upper surface 156 and 158, respectively, at a height above the contact surface 112 approximately equal to the height of the castors 120, 122, and 124.

For the purpose of the present invention, the term "approximately equal" as used in referring to the height of the upper-surface of the structural members and elsewhere, refers to a height which is preferably below the upper periphery of the castors, but which may also be equal to that height or even slightly greater without interfering with the operation of the present invention.

The integral frame of the basic mechanic's creeper 110 shown in FIG. 1 is also provided with a plurality of weight bearing cross-bracing members 148 and 150. These cross-bracing members 148 an 150 are shown in rigid, mating engagement with the structural members 144 and 146. Such engagement may be accomplished by any suitable means, such as bolting, welding or the like. In addition, the cross-bracing members 148 and 150 are also operatively engaged to the connection mechanisms 132, 134, and 136 of the upper periphery of each castor 120, 122, and 124.

In this manner the weight of the structural members of the mechanic's creeper of the present invention, as well as any load placed thereon are transferred to the castors.

One skilled in the art would recognize that while the structural members 144 and 146 are depicted as hollow tubular members in FIG. 1, and both upper and lower surfaces are discussed, it is certainly possible, and well within the scope of the present invention, that these structural members may be of some different suitable shape and still meet the functional needs of the present invention. Further, the term "surface" as used herein for the upper and lower periphery of the structural members both in this description and the claims is intended to encompass all such operative shapes.

Further, although the preceding description of the basic embodiment of the present invention employs two weight bearing, cross-bracing members, the invention should not be viewed as limited thereby, and any number of such cross-bracing members could be added to the structure to serve a particular application.

Figure 2:
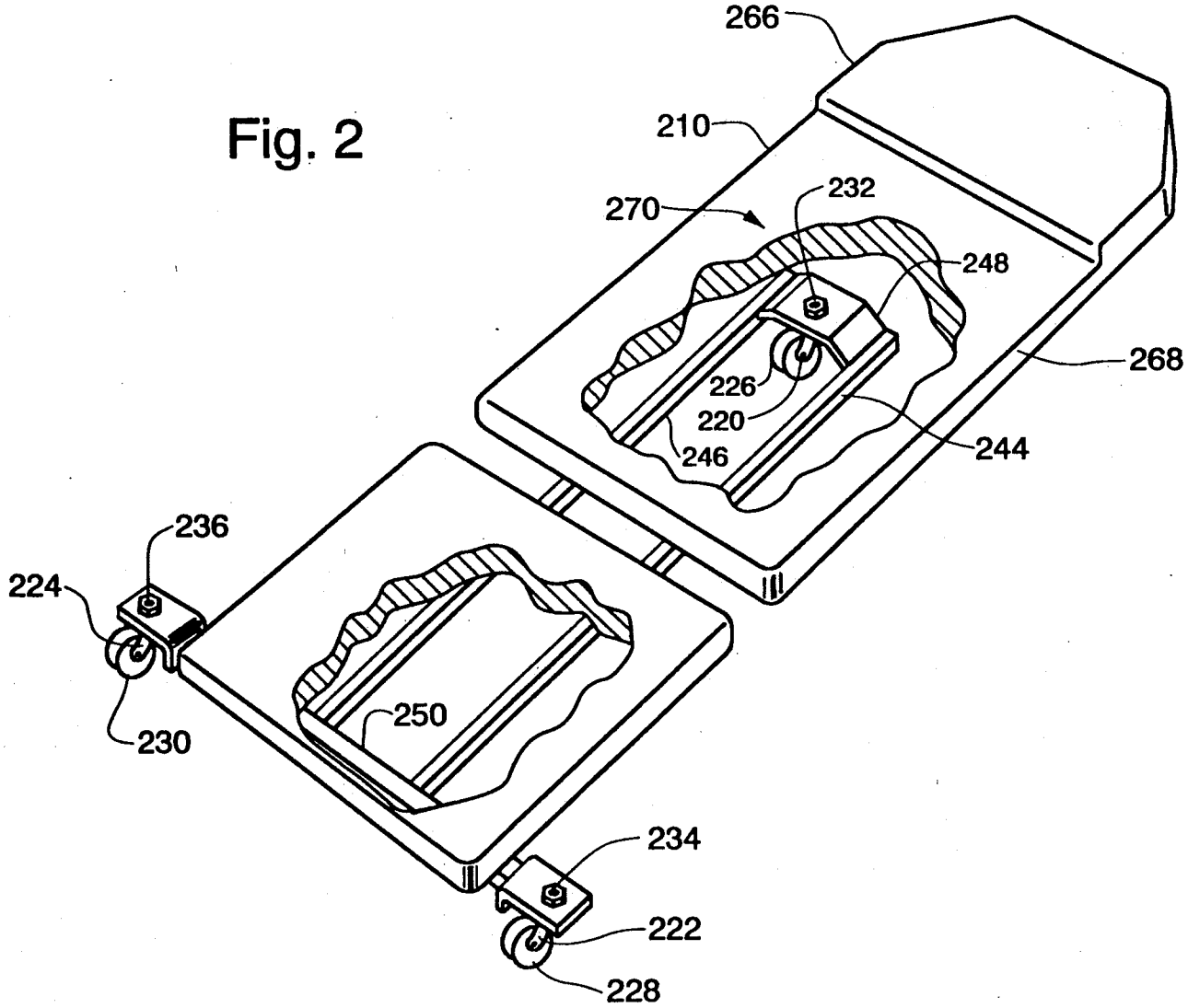
FIG. 2 shows an embodiment of the present invention as it would be adapted for use as a mechanic's creeper.

FIG. 2 shows a partially broken-away view of an embodiment of the mechanic's creeper of the present invention as it would be used in many situations. In the drawing, the creeper 210 is shown as a flat, padded device having a more heavily padded portion 266 at one end thereof intended to be employed by the user as a headrest. The creeper 210 is shown with a uniform load-bearing surface 268 which is advantageously fully covered with some form of padding 270.

In the cut-away portion of FIG. 2, can be seen the components of the basic structure previously described. Thus, structural members 244 and 246 are shown with cross-bracing members 248 and 250. Castor 220 is shown in operative engagement with cross-bracing member 248 by means of the connection mechanism 232, permitting rotational member 226 to make contact with a surface. Likewise, castor 222 operatively engages cross-bracing member 250 by means of the connection mechanism 234, permitting rotational member 228 to make contact with a surface, and castor 224 operatively engages cross-bracing member 250 by means of the connection mechanism 236, permitting rotational member 230 to make contact with a surface. The three rotational members, arrayed in a triangular arrangement as they are, insure that the contact surface is always a plane.

Figure 3A:
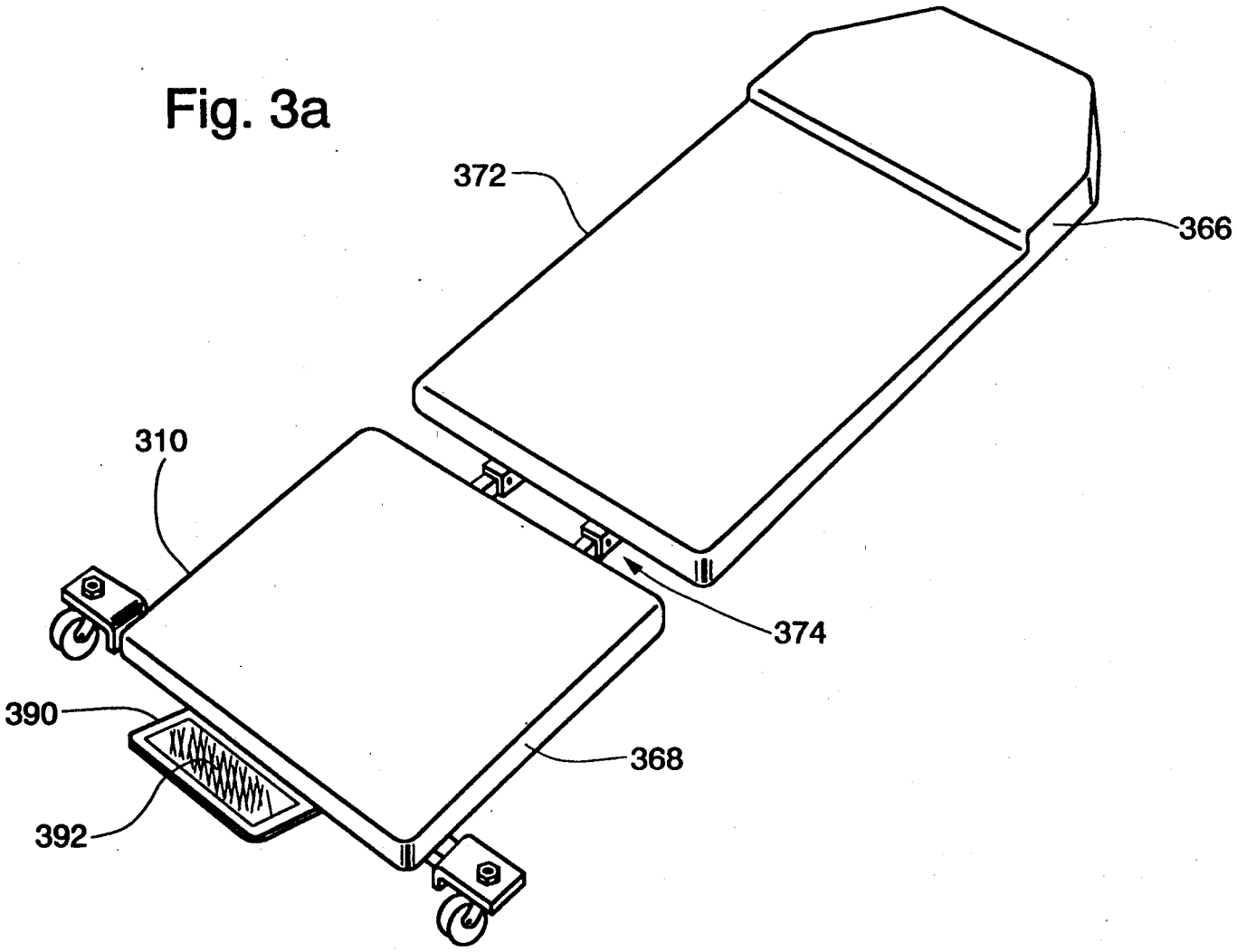
FIG. 3*a* shows an embodiment of the present invention as it would be adapted for use as a mechanic's creeper provided with a tiltable inclined backrest.

FIG. 3*a* shows an embodiment of the present invention as it would be adapted for use as a mechanic's creeper provided with a tiltable inclined backrest. The embodiment shown as 310 in FIG. 3*a* is very similar to the embodiment 210 of FIG. 2, except that a portion of the load-bearing surface is not fixed in place with respect to the basic structure. Rather, backrest portion 372 of the load-bearing surface 368 is attached by some flexible means, such as the hinge 374 illustrated.

Figure 3B:
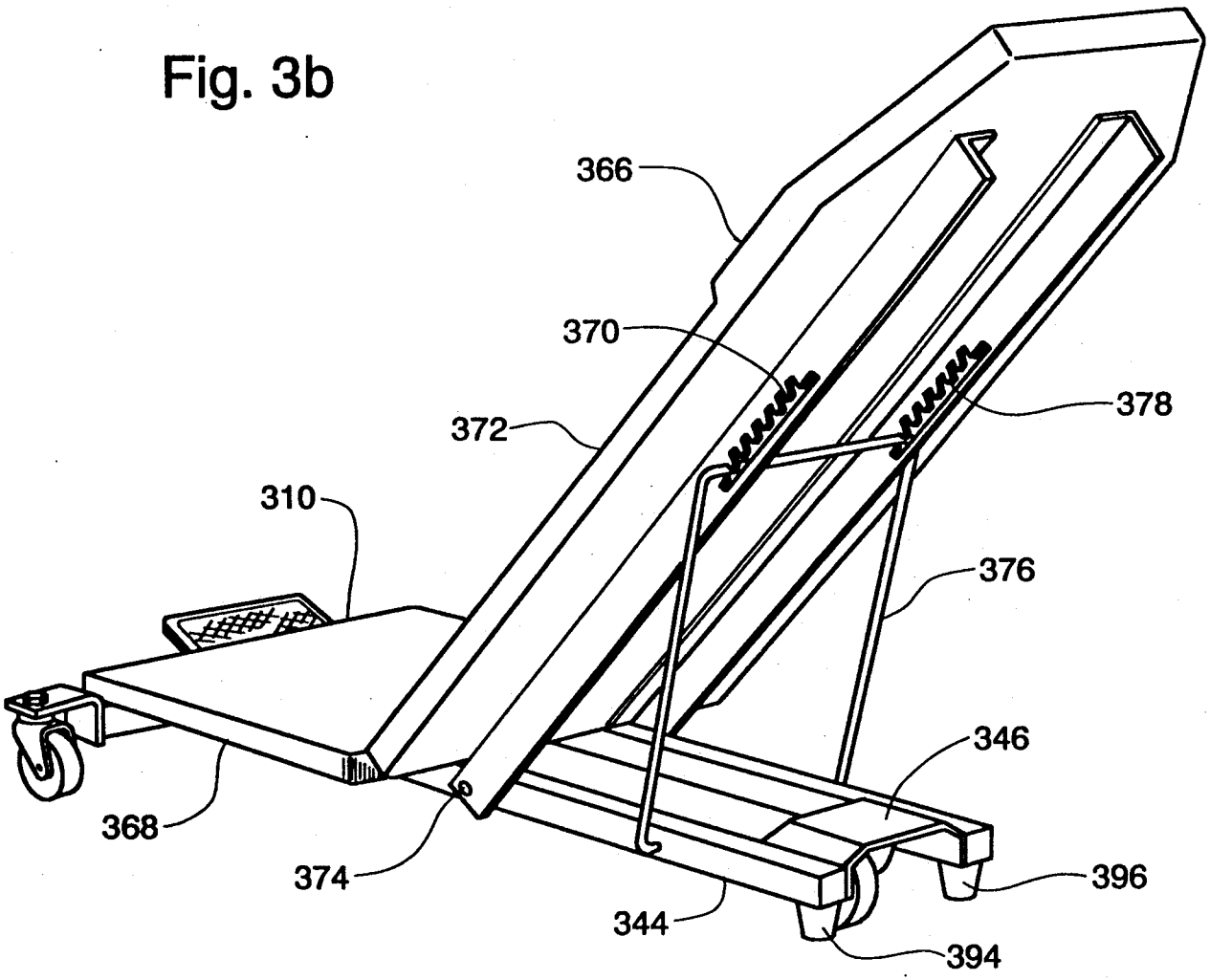
FIG. 3*b* shows an embodiment of the present invention as it would be adapted for use as a mechanic's creeper provided with a tiltable inclined backrest.

FIG. 3*b* shows embodiment 310 of the present invention as it would be adapted for use as a mechanic's creeper provided with a tiltable inclined backrest. In this illustration, however, the backrest portion 372 is elevated into a support position. This elevation may be accomplished in any of the many ways known to the art. Elevation is illustrated in FIG. 3*b* by the extension bracket 376 and extension holders 378 and 370.

Also shown in FIG. 3*b* are stabilizers 394 and 396. these lateral stabilizers are useful to prevent the creeper from tipping over, particularly when the backrest portion 372 is elevated into a support position. These lateral stabilizers 394 and 396 may advantageously be placed at the lower periphery of the structural members 344 and 346, although alternative placement is possible.

Thus the embodiment shown in FIG. 3*a* and FIG. 3*b* may be employed as a ground level mechanic's creeper. This embodiment may also allow the user to enter under a truck or other vehicle and maneuver himself into position for work, then raise the backrest extension to a suitable height. This embodiment thus allows the user to raise the backrest to a height which is sufficiently high to make working more convenient.

An additional feature of the present invention is also shown in FIG. 3*a*. A "flip-up" step 390, preferably provided with a traction surface 392, is illustrated which can be used to maneuver the creeper on the work surface by someone in a standing position. In addition, the flip-up step 390 allows a user to exert force downward, lifting the opposite end of the creeper to a height where someone in a standing position can catch and hold the creeper for transportation to another work site.

One of the advantages of the present invention is that it is able to employ straight castor rather than the offset castors commonly employed in the products commercially available today. Offset castors are employed in the prior art to reduce the height of the creeper, but the present invention is able to employ straight castor without sacrificing any reduction in height. In fact, the present invention has been advantageously employed in an embodiment which actually reduces the height of a mechanic's creeper over the common commercial unit of the prior art.

Castors of the kind advantageously employed by the present invention are commercially available. One skilled in the art would recognize that suitable commercial alternatives exist and would be able to select among those available for the particular purpose for which the creeper is to be employed.

The structural members and cross-bracing members employed advantageously in the present invention are fashioned from extruded aluminum, although several suitable alternatives are available, as one skilled in the art would recognize readily. Likewise, the load bearing surface of the preferred embodiment is fashioned from aluminum sheet, though suitable alternatives exist.

The padding, where padding is desirable, is preferably some kind of foamed elastomer, and foam rubber has been used to advantage, though other suitable materials exist. Other hardware, brackets and supports may be fashioned from aluminum or other suitable material.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What I claim is:

1. A mechanic's creeper having improved strength and increased mobility without sacrifice in work height, for use on a work surface, which creeper comprises:

a triangular array of three straight castors, said triangular array having at least two sides approximately equal in length, and defining a horizonal plane of surface contact therebelow, each said castor having at its lower periphery a surface contact member rotational in a plane vertical to the horizonal to the plane of surface contact, and at its upper periphery a load-bearing connection mechanism member rotational in a horizontal plane parallel to the plane of surface contact; and an integral frame operatively engaged to and suspended from the connection mechanism members of said castors and comprising:

a plurality of structural members, each structural member having a lower periphery located above the plane of surface contact and an upper support surface at a height above the contact surface approximately equal to the height of the castors; and, a plurality of weight bearing cross-bracing members in mating engagement with said structural members and wherein each cross-bracing member operatively engages at least one connection mechanism member at the upper periphery of at least one of said castors;

thereby transferring the weight of the structural members and any load placed thereupon to the castors.

2. The mechanic's creeper of claim 1 wherein the top surface of the structural members are provided with a uniform load-bearing surface.

3. The mechanic's creeper of claim 2 wherein said load-bearing surface may be comprised of at least one individual piece.

4. The mechanic's creeper of claim 2 wherein the load-bearing surface is provided with padding suitable for the comfort of someone lying thereon.

5. The mechanic's creeper of claim 4 wherein the load-bearing surface is further provided with tiltable inclined backrest portion.

6. The mechanic's creeper of claim 5 wherein said tiltable inclined backrest portion is further provided with a padded headrest of greater height.

7. The mechanic's creeper of claim 2 wherein said load-bearing surface is further provided with a padded headrest of greater height.

8. The mechanic's creeper of claim 2 further provided with a flip-up step member a first end thereof to allow a user to exert force downward, lifting the opposite end of the creeper to a height where the user can catch and hold the creeper.

9. The mechanic's creeper of claim 8 wherein said flip-up step member is further provided with a traction surface.

10. The mechanic's creeper of claim 2 further provided with lateral stabilizers to prevent the creeper from tipping over in use.

11. The mechanic's creeper of claim 10 wherein said lateral stabilizers are affixed to the lower periphery of said structural members.

* * * * *